United States Patent [19]

Kolm et al.

[11] 4,345,305

[45] Aug. 17, 1982

[54] PORTABLE ELECTRONIC SAFETY FLARE SYSTEM

[75] Inventors: Henry H. Kolm, Wayland; Eric A. Kolm, Brookline, both of Mass.

[73] Assignee: Flik, Inc., Cambridge, Mass.

[21] Appl. No.: 177,129

[22] Filed: Aug. 11, 1980

[51] Int. Cl.[3] ..... F21L 7/00

[52] U.S. Cl. ....., 362/186; 362/102; 362/158; 362/202; 362/205; 362/222; 362/223

[58] Field of Search ..... 362/102, 202, 158, 186, 362/205, 206, 222, 223

[56] References Cited

U.S. PATENT DOCUMENTS 4,055,840 10/1977 Uchytil ..... 362/202 X

*Primary Examiner*—Stephen J. Lechert, Jr.

*Attorney, Agent, or Firm*—Joseph S. Iandiorio

[57] ABSTRACT

A portable electronic safety flare including an elongate hollow tube, at least a portion of which is transparent; electronic strobe light circuit means in the tube; a strobe light mounted in the transparent portion of the tube and driven by the strobe light circuit means; a power supply disposed in the tube and interconnected with the strobe light circuit means; a push switch interconnected with the strobe light circuit means for actuating the strobe light; mounting means for supporting the push switch at a first end of the tube; first cap means for closing the first end of the tube; the first cap means having a flexible portion for permitting pressure to be applied through it to actuate the push switch; and second cap means for closing the second end of the tube.

11 Claims, 10 Drawing Figures

PORTABLE ELECTRONIC SAFETY FLARE SYSTEM

FIELD OF INVENTION

This invention relates to a portable electronic safety flare system.

BACKGROUND OF INVENTION

Conventional flares are not re-usable: once lit they burn for approximately twenty minutes. They are a constant fire hazard when lit and so their use is somewhat limited. The fire hazard persists to some extent even after the flare is burned out and so it must be disposed of carefully. Electronic strobe flares are available but they are relatively expensive, large and heavy and tend to short battery life. In addition, the flash mechanism is often quite delicate and usually provides only unidirectional output.

SUMMARY OF INVENTION

It is therefore an object of this invention to provide an improved portable electronic safety flare system which is small, compact and lightweight.

It is a further object of this invention to provide such a system which is inexpensive and uses standard components throughout.

It is a further object of this invention to provide such a system which is rugged, waterproof and floats.

It is a further object of this invention to provide such a system which produces omnidirectional, brilliant light visible for several miles and operates for a long period on small batteries.

It is a further object of this invention to provide such a system which includes a case that also functions as a stand.

The invention features a portable electronic safety flare system primarily housed in an elongate hollow tube, at least a portion of which is transparent. There is electronic strobe light circuit means in the tube for operating a strobe light mounted in a transparent portion of the tube. A power supply is also disposed in the tube and interconnected with the strobe light circuit means. A push switch actuates the strobe light circuit. There are mounting means for supporting the push switch at a first end of the tube and first cap means for closing that first end of the tube. The first cap means has a flexible portion which permits pressure to be applied through it to actuate the push switch. Second cap means close the second end of the tube.

In a preferred embodiment the electronic strobe light circuit means may include a circuit board which may be cemented to the inside of the tube. The strobe light may be supported by that circuit board. The mounting means may include a cup member which has a flange for engaging the first end of the tube between the end of the tube and the first cap means. The power supply may include a battery holder having a base with a resilient pad mounted thereon for engaging the inner surface of the tube and assisting in securing the power supply in position in the tube. The power supply may also include extended wire means which interconnect the power supply and the circuit means and permit removal of the power supply from the tube for replacement of the batteries. In addition the extended wire means may be used to fill any space between the power supply and the inner surface of the tube to assist in securing the power supply in position in the tube. A resilient block of material such as sponge rubber may be disposed in the second end of the tube between the second cap means and the power supply for assisting in securing the power supply in position in the tube.

There may also be included a stand formed of a tubular member with two pairs of opposing holes near its base that receive a pair of elongate members one passed through each pair of holes to produce an X-shaped support. The tubular member may be larger than the entire elongate hollow tube with its end caps and have at least a portion which is transparent for alignment with the transparent portion of the elongate hollow tube. The tubular member may also have a third cap means for closing it to form a case for the elongate hollow tube with the first and second cap means.

DISCLOSURE OF PREFERRED EMBODIMENT

Other objects, features and advantages will occur from the following description of a preferred embodiment and the accompanying drawings, in which.

Figure 1:
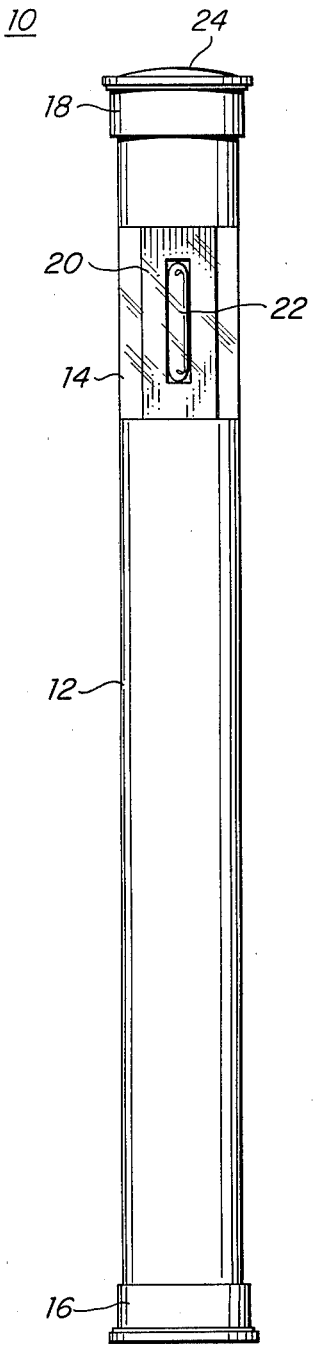
FIG. 1 is a front elevational view of a portable electronic safety flare according to this invention.
Figure 2:
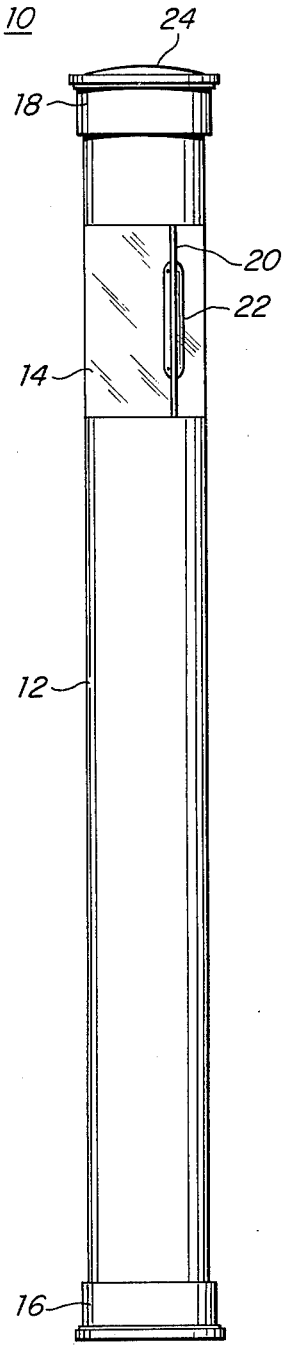
FIG. 2 is a side elevational view of the flare of FIG. 1.
Figure 3:
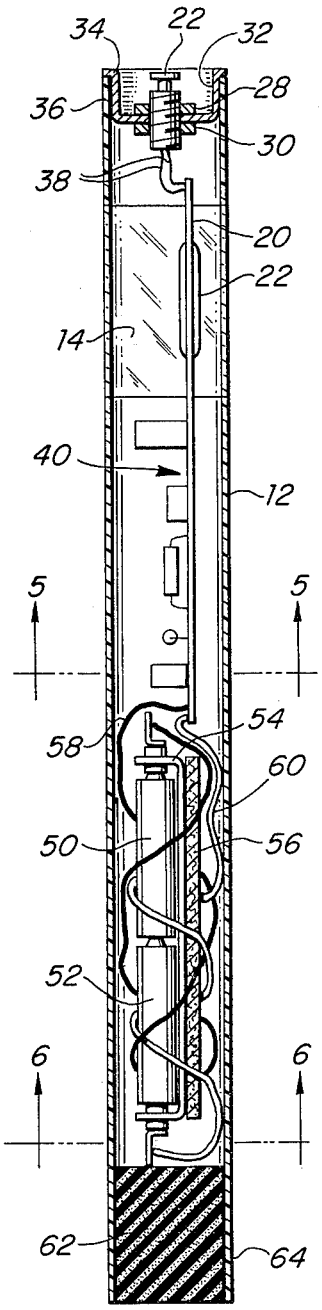
FIG. 3 is a side elevational view in cross section of the flare of FIG. 2 with the end caps removed.
Figure 4:
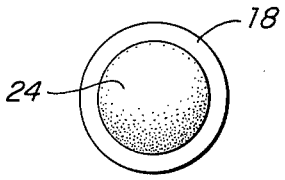
FIG. 4 is an end view of the top end of the flare of FIG. 1.
Figure 5:
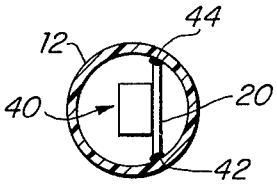
FIG. 5 is a cross-sectional view taken along line 5—5 of FIG. 3.
Figure 6:
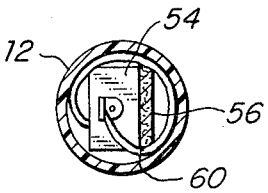
FIG. 6 is a cross-sectional view taken along line 6—6 of FIG. 3.

The portable electronic safety flare according to this invention may be accomplished using an elongate tube approximately fourteen inches long and one and one-quarter inches in diameter made of thick-wall plastic tubing such as Plexiglass or Lexan. A conventional electronic strobe light circuit is mounted on a circuit board cemented to the inside of the tube. A Xenon strobe light supported by the circuit board is positioned in the transparent part of the tube, where it can act as a 360° source. Typically the transparent portion is closer to one end and the power supply is located closer to the other end of the tube. The power supply typically includes a standard battery holder with a resilient material such as felt fixed to its base to accommodate the battery holder to the inside of the cylindrical tube and assist in securing the battery holder with the batteries snugly in the tube. The batteries may be connected to the circuit by extra-length wires which enable the battery holder to be removed from the tube for inspection and replacement of the batteries. The extra-length wires when wrapped about the battery holder also act to make a snug fit between the battery holder and the tube. A block of resilient material such as sponge rubber is placed in the end of the tube, also for the purpose of helping to secure the battery holder in position securely in the tube. Finally, a cap is placed over the battery end of the tube to sealingly engage the tube and make it waterproof. A cap is also applied at the other end of the tube, where is located mounting means that holds a push-on, push-off switch. The cap at that end has a stretched center portion to allow for sufficient travel to operate the push switch by the application of finger pressure to the cap. The mounting means typically is formed as a cup with a flange that rests on the end of the tube and is held in place by the cap. Both caps and the mounting cup are standard plastic articles which are used to protect the threaded ends of pipe in shipment and handling. The entire flare may be shipped in a case at least a portion of which, typically all of which, is transparent. The lower portion of the case has two pairs of oppositely spaced holes which receive a pair of cross straps, rods or sticks which when inserted in those opposing holes provide an X-shaped support for the stand into which the flare may be placed. The case may have a cap to close its upper end. There is shown in FIGS. 1 and 2 a flare 10 according to this invention which includes an elongate plastic tube 12 having a transparent portion 14, and two caps, lower cap 16 and upper cap 18. Visible in transparent portion 14 is the portion of the circuit board 20 which contains Xenon flash tube 22. Cap 18 includes a distended portion 24, shown in end view in FIG. 4, to enable sufficient motion to provide travel necessary to actuate push-on, push-off switch 26, FIG. 3. Switch 26 has a threaded body mounted by means of nuts 28, 30, in the base of mounting member cup 32, whose flanged upper end 34 rests on the end 36 of tube 12. A pair of wires 38 interconnects switch 26 with the circuit 40 mounted on the lower portion of circuit board 20. Circuit board 20 may be fastened by cement beads 42, 44, FIG. 5, at its edges to tube 12 above and below transparent portion 14. Circuit 40 receives power from a pair of AA batteries 50, 52 mounted in battery holder 54, which has a resilient felt pad 56 mounted to its base. Pad 56 aids in providing a resilient, snug fit between the inside of tube 12 and the battery holder to keep it from moving about freely, FIG. 6. Wires 58 and 60, FIG. 3, are long to permit removal of battery holder 54 with batteries 50, 52 from the tube for inspection and replacement. In addition, wires 58 and 60, when wrapped about batteries 50, 52 in holder 54, provide added means for snugly fitting battery holder 54 and batteries 50, 52, FIG. 6, in tube 12. A plug of resilient material such as sponge rubber 62, FIG. 3, is disposed in the lower end 64 of tube 12 to further assist in positioning battery holder 54.

Figure 7:
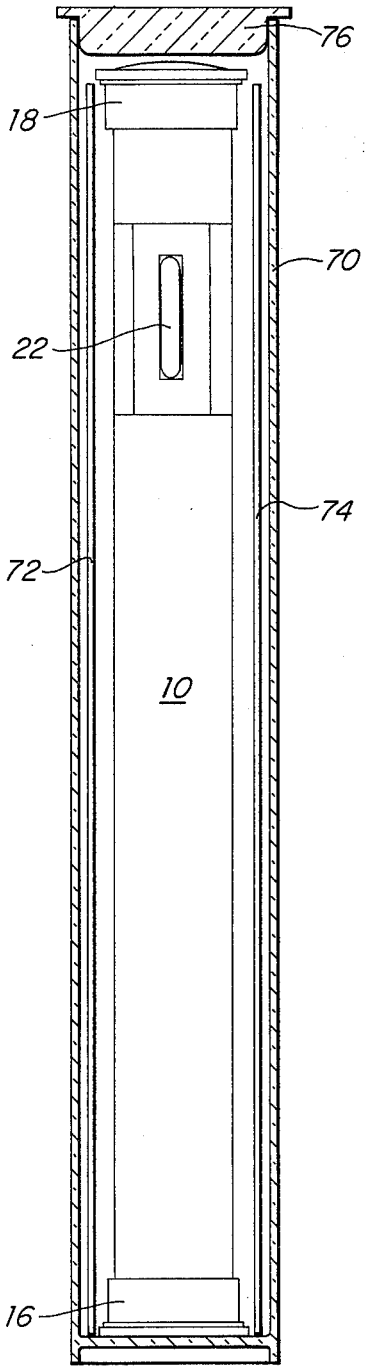
FIG. 7 is a front elevational view of the flare of FIG. 1 disposed in a carrying case/stand with cross straps.
Figure 8:
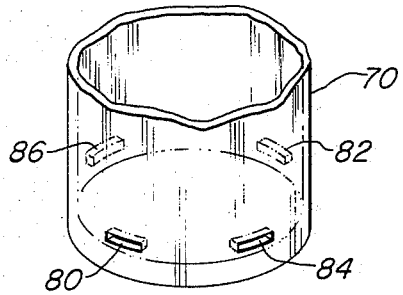
FIG. 8 is an enlarged axonometric view of the lower portion of the case of FIG. 7 showing two pairs of opposing holes for receiving the cross straps.
Figure 9:
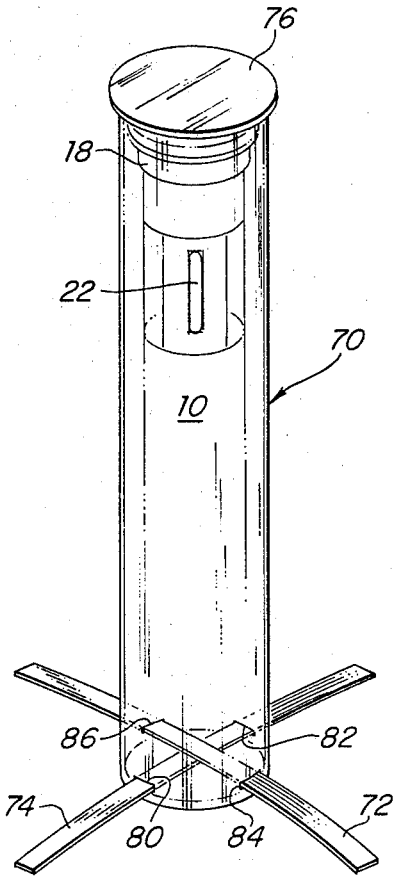
FIG. 9 is a view of the case of FIG. 7 containing the flare with the cross straps inserted and with portions of the flare omitted for clarity.

Flare 10 may be shipped or carried in a large clear plastic tube 70, FIG. 7, which also has room for carrying straps 72 and 74 and receives a cap 76 at its upper end. At its lower end case 70 includes two pairs of opposing holes. The first pair 80, 82 are diametrically opposite each other, and the second pair 84, 86 are also diametrically opposite each other and are typically orthogonally placed with respect to holes 80 and 82. Steel straps 72 and 74 are inserted one through one pair of holes and one through the other, FIG. 9, so that the cross straps provide extra stability for case 70 when it is used as a stand for flare 10. Alternatively, the upper portion of case 70 and cap 76 may be done away with and just the lower portion retained for use as a stand only, rather than a carrying case as well.

Figure 10:
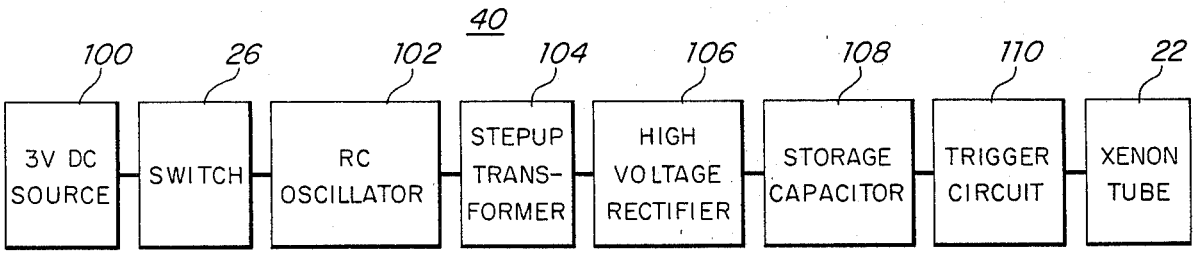
FIG. 10 is a block diagram of a conventional strobe circuit which may be used in this invention.

The particular implementation of circuit 40 is not a part of this invention, and any conventional strobe circuit may be used. One example of such a circuit is shown in FIG. 10 composed of a three-volt D.C. source 100, typically comprised of two batteries in series and a switch, such as switch 26. Upon actuation of switch 26, power is supplied to an R.C. oscillator 102 whose output, typically 300 volts, is converted by high voltage rectifier 106 and delivered to capacitor 108 which stores 0.5 joules of energy at 300 volts each second and then delivers a 4800-volt pulse through trigger circuit 110 to fire Xenon tube 22 for one-half of a millisecond.

Other embodiments will occur to those skilled in the art and are within the following claims:

What is claimed is:

1. A portable electronic safety flare system comprising:

an elongate hollow tube at least a portion of which is transparent;

electronic strobe light circuit means in said tube;

a strobe light mounted in a transparent portion of said tube and driven by said strobe light circuit means;

a power supply disposed in said tube and interconnected with said strobe light circuit means;

a push switch interconnected with said strobe light circuit means for actuating said strobe light;

mounting means for supporting said push switch at a first end of said tube;

first cap means for closing said first end of said tube; said first cap means having a flexible portion for permitting pressure to be applied through it to actuate said push switch; and second cap means for closing the second end of said tube.

2. The portable electronic safety flare system of claim 1 in which said electronic strobe light circuit means includes a circuit board.

3. The portable electronic safety flare system of claim 2 in which said circuit board is cemented to said tube.

4. The portable electronic safety flare system of claim 2 in which said strobe light is supported by said circuit board.

5. The portable electronic safety flare system of claim 1 in which said mounting means includes a cup member having a flange for engaging said first end of said tube between said first end of said tube and said first cap means.

6. The portable electronic safety flare system of claim 1 in which said power supply includes a battery holder having a base with a resilient pad mounted thereon for engaging the inner surface of said tube and assisting in securing said power supply in position in said tube.

7. The portable electronic safety flare system of claim 6 in which said power supply includes extended wire means interconnecting said power supply and said circuit means for permitting removal of said power supply from said tube, and accommodating for the space between the power supply and inner surface of said tube to assist in securing said power supply in position in said tube.

8. The portable electronic safety flare of claim 1 further including a resilient block in said second end of said tube, between said second cap means and said power supply, for assisting in securing said power supply in position in said tube.

9. The portable electronic safety flare system of claim 1 further including a stand having a tubular member with two pairs of opposing holes near its base and a pair of elongate members for engagement one with each pair of holes to produce an X-shaped support.

10. The portable electronic safety flare system of claim 9 in which said tubular member is larger than and receives the entire elongate hollow tube with first and second cap means, and has at least a portion which is transparent for alignment with the transparent portion of said elongate hollow tube.

11. The portable electronic safety flare system of claim 10 in which said tubular member includes third cap means for closing said tubular member to form a case for said elongate hollow tube with first and second cap means.

* * * * *